US009279232B2

(12) United States Patent
Jagdale

(10) Patent No.: US 9,279,232 B2
(45) Date of Patent: Mar. 8, 2016

(54) FRONT HEAD NUT POCKET CONFIGURATION FOR HYDRAULIC HAMMER

(71) Applicant: Caterpillar Inc., Peoria, IL (US)

(72) Inventor: Rakesh Jagdale, Waco, TX (US)

(73) Assignee: Caterpillar Inc., Peoria, IL (US)

( * ) Notice: Subject to any disclaimer, the term of this patent is extended or adjusted under 35 U.S.C. 154(b) by 606 days.

(21) Appl. No.: 13/650,828

(22) Filed: Oct. 12, 2012

(65) Prior Publication Data

US 2014/0102740 A1 Apr. 17, 2014

(51) Int. Cl.

| | |
|---|---|
| ***B25D 9/04*** | (2006.01) |
| ***E02F 5/32*** | (2006.01) |
| ***E02F 3/96*** | (2006.01) |
| ***E21B 1/38*** | (2006.01) |

(52) U.S. Cl.

CPC . *E02F 3/966* (2013.01); *B25D 9/04* (2013.01); *E02F 5/323* (2013.01); *E21C 3/04* (2013.01)

(58) Field of Classification Search

CPC ..... B25D 9/04; B25D 17/00; E02F 3/966
USPC ..... 173/95, 114; 175/135
See application file for complete search history.

(56) References Cited

U.S. PATENT DOCUMENTS 3,601,207 A * 8/1971 Coski ..... E21C 27/30 175/213
3,661,216 A * 5/1972 Yamanaka ..... B25D 9/08 173/138
3,688,646 A * 9/1972 Flick ..... F16J 10/02 92/146
3,866,690 A * 2/1975 Lance ..... B25D 9/12 173/127
3,921,734 A * 11/1975 Goodfellow ..... E21B 7/28 175/364
4,018,291 A * 4/1977 Anderson ..... B25D 17/12 173/135
4,181,183 A * 1/1980 Okada ..... B25D 9/145 173/204
4,415,208 A * 11/1983 Goyarts ..... E21C 35/18 175/413
5,060,761 A 10/1991 Arndt et al.
6,095,257 A * 8/2000 Lee ..... B25D 17/24 173/162.1
8,146,677 B2 * 4/2012 Kim ..... B25D 17/00 173/115

FOREIGN PATENT DOCUMENTS

JP 2005299091 A * 10/2005

OTHER PUBLICATIONS

Breaker Technology Inc., TB Series Hydraulic Brakers Owner's Manual, Jan. 1, 2008, United States.

* cited by examiner

*Primary Examiner* — Thanh Truong
*Assistant Examiner* — Patrick Fry
(74) *Attorney, Agent, or Firm* — Miller, Matthias & Hull LLP

(57) ABSTRACT

A hydraulic hammer may include a power cell adapted to reciprocally drive a piston along an axis. The piston may, in turn, drive a hammer tool having a first end juxtaposed against the piston for accommodating cyclic impacts by the piston. While the first end of the hammer tool may be contained within a housing, the other end may extend from the housing for impacting rock, for example. The power cell and housing are axially secured together by a plurality of tie rods and nuts secured to ends of the tie rods, and the housing may include exterior pockets for accommodating the nuts. Each nut may have a circular exterior surface, and each nut pocket may have a generally elliptical interior surface, such that the exterior surface of each nut may be configured to engage at least two spaced apart areas of a corresponding interior surface of each nut pocket.

16 Claims, 4 Drawing Sheets

FRONT HEAD NUT POCKET CONFIGURATION FOR HYDRAULIC HAMMER

TECHNICAL FIELD

This disclosure relates to design improvements for optimizing longevity and/or reducing the maintenance and/or replacement of parts in hydraulic hammers subjected to harsh cyclic stresses. More particularly, the disclosure relates to an improved nut pocket configuration for the front heads of hydraulic hammers.

BACKGROUND

Hydraulic hammers are generally used on worksites to demolish and break up hard objects, including rocks, concrete, asphalt, and frozen ground. The hammers may be mounted to machines, such as excavators and backhoes, for example. The hammers may alternatively be powered by pneumatic pressure sources, as opposed to only hydraulic sources. In either event, a high-pressure fluid may be utilized within the hammer to cyclically drive a piston to strike a work tool, which in turn may repetitively strike the object of demolition for breaking that object into smaller pieces, generally for easier removal from a worksite.

To the extent that hydraulic hammers are routinely subjected to harsh conditions, various parts of the hammers may have relatively short life cycles. Constant efforts have been made to increase life cycles of hammer parts, more typically including improvements in metallurgy and lubrication. For example, U.S. Pat. No. 5,060,761 discloses a lubrication system that offers a limit switch to manage lubricant levels in a reservoir. The system also includes a horn along with a warning lamp to alert an operator of a low lubricant condition. A control valve is adapted to interrupt operation of the hammer whenever lubricant level falls below a predetermined amount.

It may be beneficial to provide a hydraulic hammer that better accommodates cyclic stress loads, as particularly applied to parts employed in the hammer, and particularly in the front head thereof, so as to cushion and/or reduce impact loads without need for changes in part sizes and/or the metallurgy of parts.

SUMMARY OF THE DISCLOSURE

In one aspect, the hydraulic hammer of this disclosure includes a power cell adapted to drive a piston configured for reciprocal movement along an axis. The piston in turn drives a hammer tool having a first end juxtaposed against the piston for accommodating cyclic impacts by the piston. One end of the hammer tool is contained within a housing, while the other end extends from the housing as an operative part of a work tool. The valve body and front head are axially secured together by a plurality of tie rods and nuts; the nuts are secured to ends of the tie rods. The housing has integral exterior pockets, and the nuts are positioned within the exterior pockets for securement to the housing.

In accordance with another aspect of the disclosure, an exterior surface of the nuts are circular in shape, while interior surfaces of the exterior pockets, sized to receive the nuts, are apertures, each defined by a circumferentially extending wall having variable radii, and each aperture maybe elliptical or oval in shape, for example. At least two exterior surface portions of each nut engage the interior wall of a nut pocket in at least two spaced apart areas of the pocket wall.

DETAILED DESCRIPTION

Figure 1:
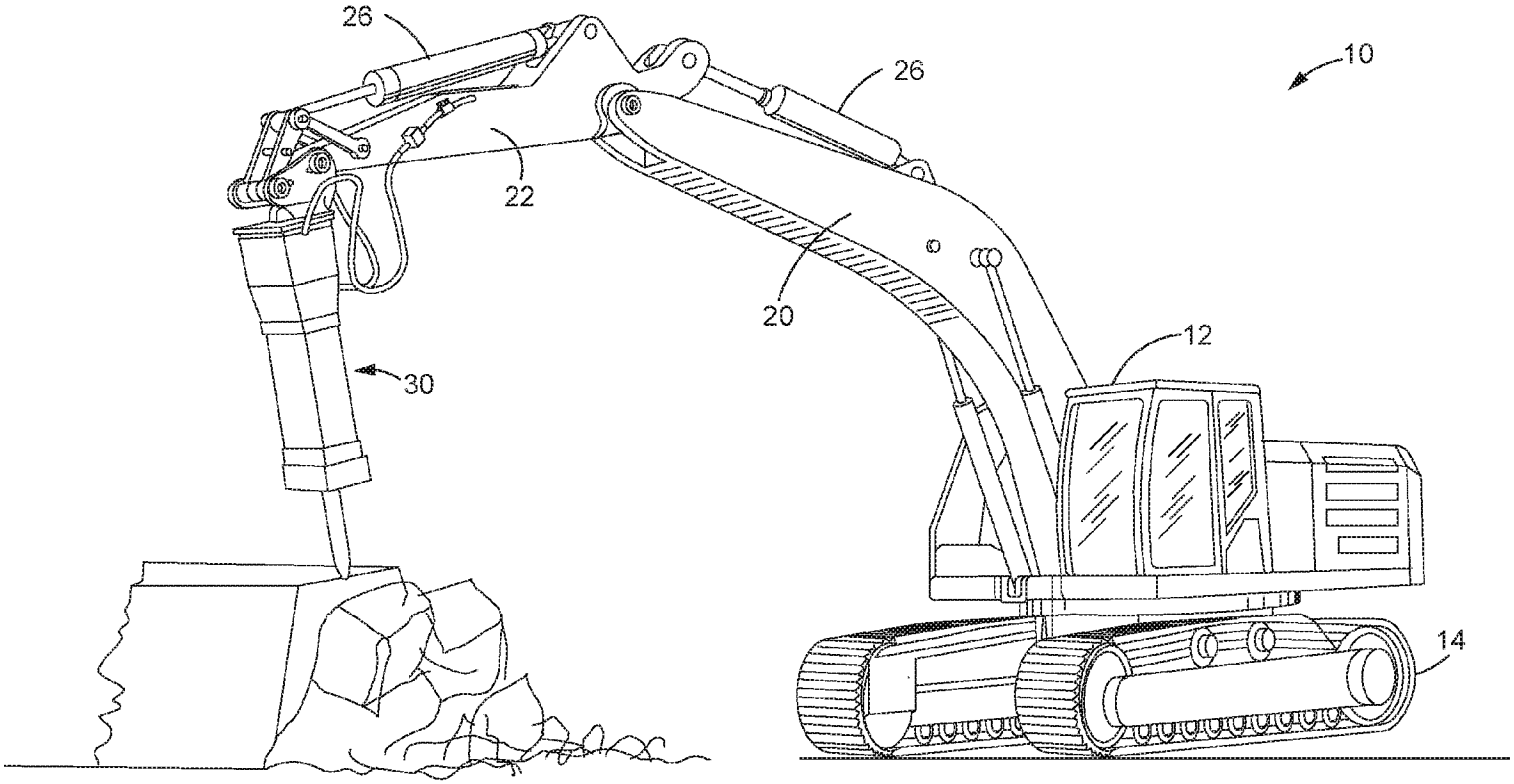
FIG. 1 is a perspective view of an excavating machine that may incorporate the disclosed hydraulic hammer.

Referring initially to FIG. 1, an excavating machine 10 of a type used for digging and removing rock and soil from a construction worksite is shown. The excavating machine 10 may incorporate a cab body 12 containing an operator station, an engine, and operating controls (none shown). The machine 10 may be supported by, and may move on, tracks 14. An extensible boom 20 may be movably anchored to the cab body 12, and an articulating stick 22, also variously called a lift arm, may be secured to and supported for movement on the boom 20.

The excavating machine 10 may incorporate a fluid powered hammer assembly 30 as depicted, or may alternatively incorporate another implement (such as a conventional bucket, not shown), at an operational end 28 of the stick 22. Hydraulic cylinder actuators 26 are utilized to move the stick 22 relative to the boom 20, and to move the hammer assembly 30 relative to the stick and boom.

Figure 2:
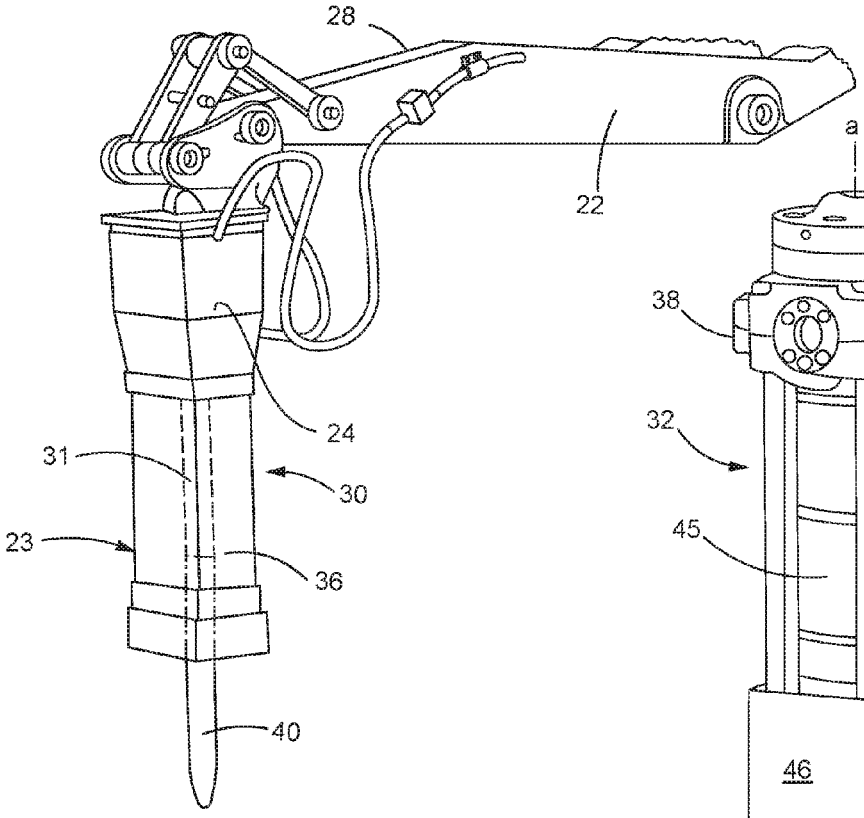
FIG. 2 is a perspective view of one exemplary embodiment of the disclosed hydraulic hammer.

Referring now also to FIG. 2, the fluid powered hammer assembly 30 includes a power cell housing cover 24, and a lower so-called front head portion 36 of a housing 23. The housing 23 is adapted for securement to a power cell 32, and for supporting a piston 31 configured for reciprocal movement by the power cell 32 along an axis. A hammer tool 40 having an upper end (not shown) may be retained within the front head portion 36 of the housing 23. The hammer tool 40 may be adapted to produce cyclic vibrational movement at an intensity sufficient to demolish rocks and dense minerals, by way of example. The functional parts of the hydraulic hammer assembly 30, including the hammer tool 40 may be constructed of a forged or otherwise hardened metal such as a refined steel, for example, to assure appropriate strength, although other suitable materials such as diamond bits for operative portions of the tool 40, for example, may be utilized within the scope of this disclosure.

Figure 3A:
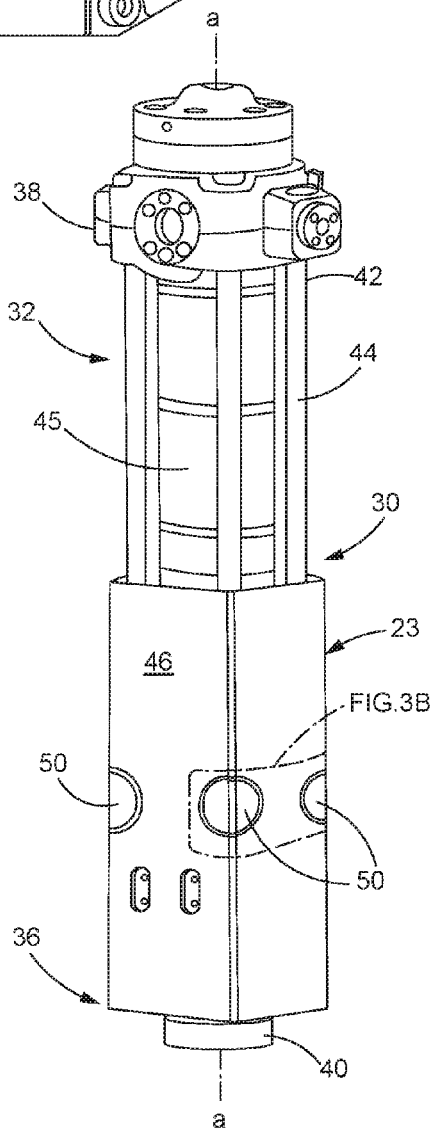
FIG. 3A is a perspective view disclosing certain interior parts of the hydraulic hammer of FIG. 2.

Referring now also to FIG. 3A, the hydraulic hammer assembly 30 is shown alone, i.e. detached from the stick 22 and with its exterior housing cover removed, to reveal an exposed upper power cell 32, and a plurality of tie rods 44 circumferentially disposed about a cylindrical piston-containing sleeve structure 45. The sleeve structure 45 contains a piston 31 (FIG. 2) adapted to drive the hammer tool 40. As such, the power cell 32 (FIG. 3A) utilizes a suitable working fluid, such as a hydraulic and/or pneumatic fluid, for example, to reciprocally impact the piston 31 against the upper end (not shown) of the hammer tool 40 (FIG. 2). The hammer tool 40 has an upper end (first end) juxtaposed against the piston 31 for accommodating cyclic impacts by the piston 31. The upper end (first end) is contained within the housing 23 and a second end extends from the housing 23. The plurality of tie rods 44 are effective to retain or hold the valve body 38 of the power cell 32 and the front head portion 36 together under harsh impact loads as can be experienced within the hydraulic hammer assembly 30.

Figure 3B:
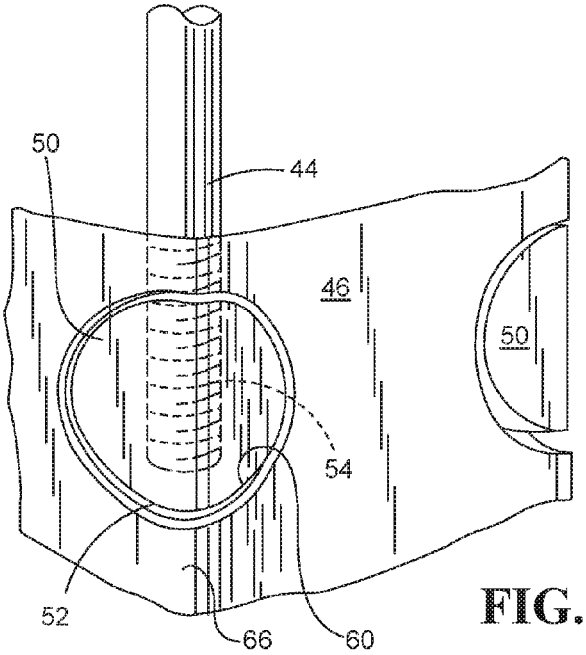
FIG. 3B is a view of an inset portion of FIG. 3A.
Figure 4A:
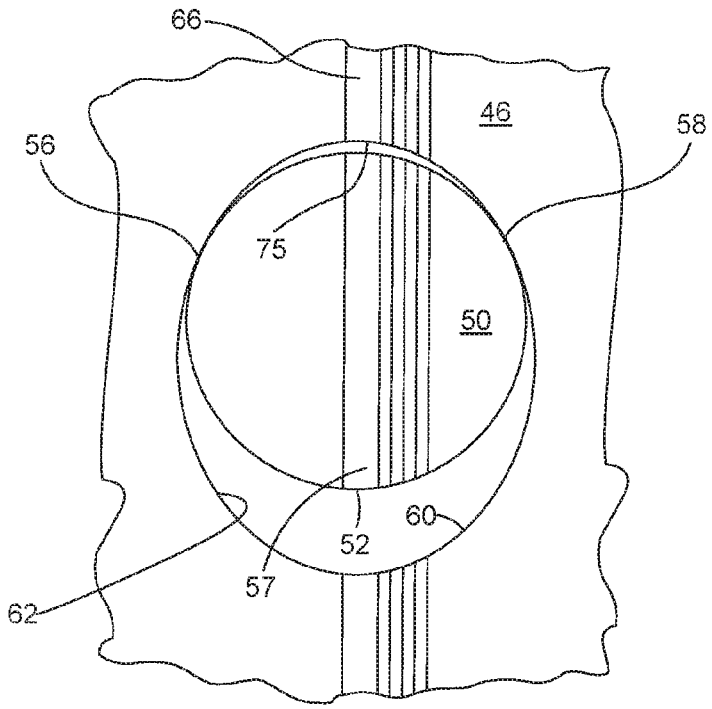
FIG. 4A is an enlarged, exaggerated aspect of the inset portion of FIG. 3B.
Figure 4B:
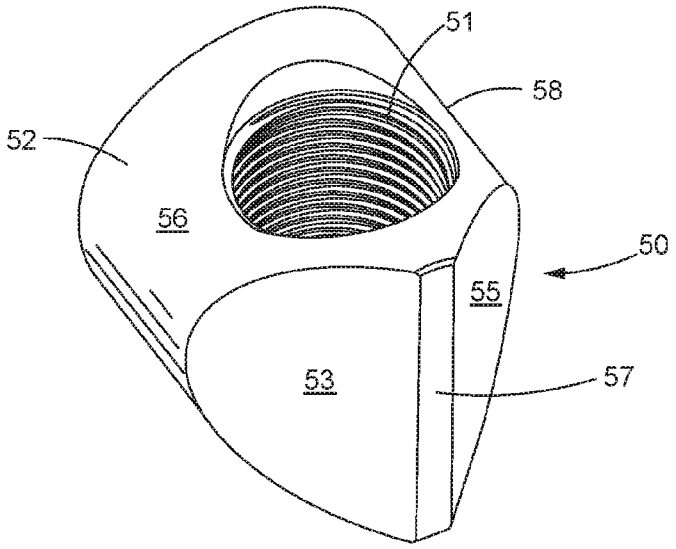
FIG. 4B is a perspective view of a nut component.
Figure 5A:
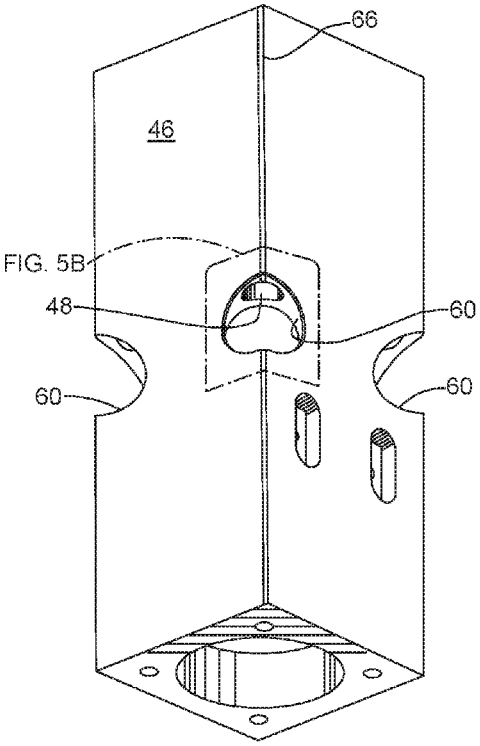
FIG. 5A is a perspective view of a front head part only of the hydraulic hammer embodiment of FIGS. 2 and 3A.
Figure 5B:
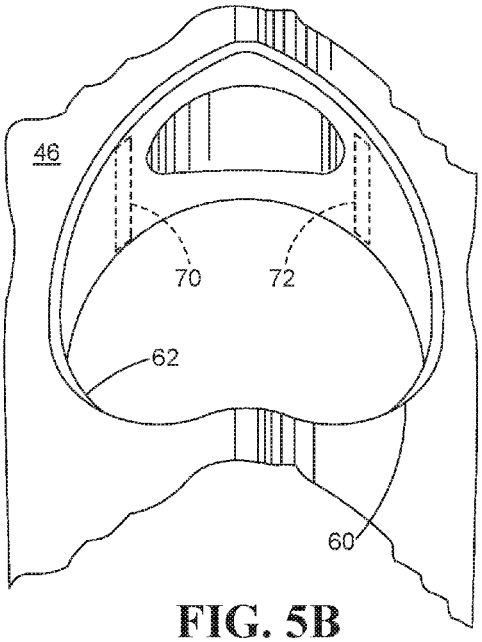
FIG. 5B is a view of an inset portion of FIG. 5A.

Referring specifically now to both FIGS. 3A, 3B, and 4A, the lower front head portion 36 defines a four sided front head 46, which functions as a structural housing to support the upper end (not shown) of the hammer tool 40 (FIG. 2). An upper end 42 of each of the tie rods 44 may be secured to the valve body 38 of the power cell 32. Referring momentarily also to FIGS. 5A and 5B, each tie rod 44 may have a threaded lower end 54 (FIG. 3B) that extends downwardly through a vertically oriented aperture or bore 48 (FIGS. 5A and 5B) within the front head 46. Each tie rod end 54 may be adapted to be threadedly secured to a tie rod nut 50, as more clearly revealed in FIGS. 3B, 4A, and 4B.

The tie rod nut 50 includes an interiorly threaded portion 51 (FIG. 4B) sized and adapted to receive the above-described threaded lower end 54 of a tie rod 44. FIGS. 3B and 4A present views of a tie rod nut 50 situated within a corresponding tie rod nut pocket 60. It may be appreciated that each tie rod nut pocket 60 may be correspondingly positioned within one corner 66 of the front head 46 to accommodate one tie rod nut 50. In the disclosed embodiment, one of four nuts 50 may be secured within one of four corresponding tie rod nut pockets 60. Each tie rod nut 50, though having a generally circular circumference in the planar frontal view presented in FIG. 4A is asymmetrically shaped when viewed from above (FIG. 4B). The shape of the nut pocket 60 in the planar frontal view is generally curvilinear and has variable radii. It is defined by a circumferentially extending interior wall, and as such may be generally elliptical or oval, as depicted. In FIG. 4A, the actual size of the nut pocket 60 relative to a corresponding tie rod nut 50 has been somewhat exaggerated for clarity purposes. I.

The views of FIGS. 4A and 4B depict two visually distinct first and second contact areas 56, 58 on the exterior body 52 of the tie rod nut 50. For this purpose, mating contact areas (as defined below) of the interior surface or wall 62 of the nut pocket 60 may be metallurgically hardened to reduce distortion and/or otherwise avoid compromise under cyclic stresses of impact at respective nut and nut pocket contact areas, as may be generated during normal operation of the hydraulic hammer assembly 30.

In FIGS. 4A and 5A, the views of the front head 46 and tie rod nut 50 may better depict the manner in which the tie rod nut pockets 60 are distributed about the four corners 66 of the front head 46. It will be appreciated that each nut 50 incorporates a pair of converging flat faces 53, 55 that define a frontal edge 57. The front edge 57 of each nut 50 is symmetrically aligned with and corresponding to one of the corners 66.

Referring now also to FIG. 5B, it may be better appreciated that the exterior body 52 of tie rod nut 50 (FIG. 3B) may contact at least two nut pocket contact areas, such as contact areas 70 and 72 (FIG. 5B) that better distribute stress loads within the interior surface 62 of the nut pocket 60.

Although the drawings and description herein may be limited to the specific embodiments disclosed, those skilled in the art may appreciate that numerous variations may fall within the spirit and scope of the appended claims.

INDUSTRIAL APPLICABILITY

In use, the disclosed improved nut pocket configuration of the hydraulic hammer may be beneficial for optimizing longevity of both the front head 46 and tie rod nuts 50, as well as for reducing downtimes for maintenance and/or replacement of various other hydraulic hammer parts.

The present disclosure takes advantage of such self-centering effect. For example, the two contact areas 56, 58 of each nut 50 are sized and configured to symmetrically engage the two corresponding contact areas 70 and 72 of each nut pocket 60, to more effectively spread the load and to thereby reduce localized stresses between each nut and nut pocket.

One set of exemplary characteristics that may be associated with the disclosed tie rod nut pocket 60 and its associated tie rod nut 50 may be described as follows.

Figure 6:
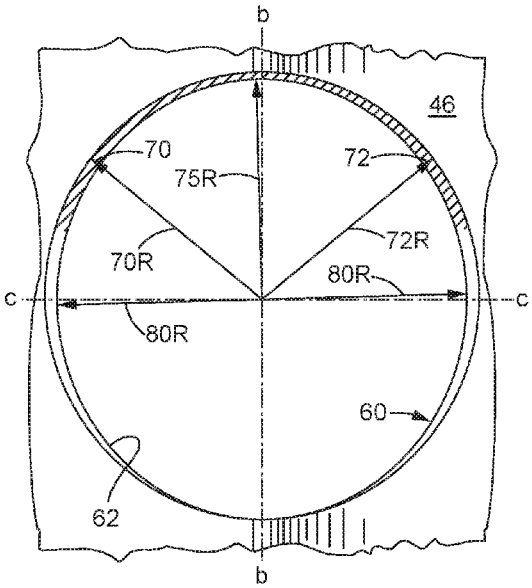
FIG. 6 is a view of the same aspect of the hydraulic hammer shown in FIG. 5B, but as a planar view rather than perspective.

Referring now to FIG. 6, the nut pocket 60 has a vertical orientation; i.e., a major axis b-b is shown oriented vertically, while a minor axis c-c is shown to be oriented horizontally, although actual orientation of the nut pocket is a function of the hammer orientation. The above-described first and second nut pocket contact areas 70 and 72 are positioned within the interior surface 62 of the tie rod nut pockets 60, as has been described. The two contact areas 70, 72 may have specific radii of curvature, 70R and 72R, respectively. Such radii of curvature, 70R and 72R, may be calculated and provided for the at least two contact areas that are adapted to be directly and physically engaged by the circumferential exterior body 52 of the nut 50.

Figure 7:
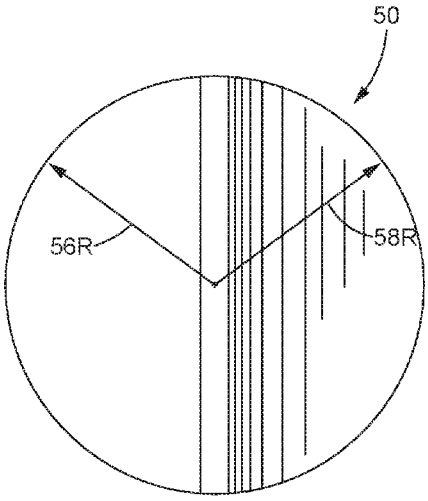
FIG. 7 is a planar view of the nut component.

Referring now to FIG. 7, a planar frontal view of the tie rod nut 50 is displayed. Specific radii of curvature 56R and 58R (which may be of equal value) of the exterior body 52 (FIG. 4A) of the tie rod nut 50 may be associated with the above-described first and second contact areas 56 and 58, respectively, of the tie rod nut 50. Such radii of curvature 56R and 58R may also be calculated and sized for making desired physical contact with the nut pocket contact areas 70 and 72. Referring now momentarily back to FIG. 4A, it will be beneficial to assure that the contact areas 56 and 58 of the tie rod nut 50 are spaced sufficiently apart from the bore 48 of the front head 46 to avoid cracking of the front head due to high stresses associated with hammer environments. For this purpose, contact areas 70 and 72 may be configured to be situated away from the bore 48, and ideally in a thicker portion of the front head 46.

Referring back to FIGS. 4A and 5B, intermediately of the contact areas 70 and 72 of the nut pocket 60, is situated an upper non-contact area 75, an area not physically contacted by the nut 50. The non-contact area 75 may have yet another, and uniquely different, radius 75R. With respect to the variable radii of the wall 62 of the pockets 60, the radii 75 R of the wall intercepted by the vertically oriented major axis b-b will be smaller than radii 80R, the radii associated with the wall 62 at the sides of the pockets 60 intersected by the horizontally oriented minor axis c-c. The radii at the contact areas 70 and 72 will fall somewhere between the radii values 75R and 80R, at the respective major and minor axes.

Among the disclosed exemplary characteristics, the largest radii will be the just described radii 80R. The next largest radii will be radii 70R and 72R, while the smallest radii may be 75R, the one associated with the intermediate non-contact area 75. Thus, the values of radii 56R and 58R of the tie rod nut 50 may be calculated and provided to fall between the limits of the smallest (75R) and the next largest radii (70R and 72R), to assure the at least two contact areas 70, 72 between the nut 50 and nut pocket 60 of a hydraulic hammer assembly 30. Finally, as shown in FIG. 5B, the contact areas 70, 72 may each be generally rectangular in shape to further optimize load spreading over otherwise linear contact areas.

By way of a formula format, the foregoing relationships among the described radii may be presented as 80R>70R>56R>75R, where the symbol ">" means "greater than". Conversely, another formula may be presented as 75R<56R<70R<80R, where the symbol "<" means "less than". Since 56R and 58R may be equal, and since 70R and 72R may be equal, alternative formulas may be presented as 80R>72R>58R>75R, and/or 75R<58R<72R<80R, for example.

A method of providing at least two points of contact between a nut 50 and a nut pocket 60 of a hydraulic hammer assembly 30 may include providing a front head 46 having nut pockets 60 circumferentially disposed about an axis a-a of the front head 46, the nut pockets 60 adapted to receive tie rod nuts 50. The method may further include providing at least two tie rod nut contact areas 70, 72 within an interior surface 62 of each nut pocket 60, and configuring the contact areas 70, 72 (70R may equal 72R) of the nut pockets 62 to have specific radii of a first value, 70R. The method may further include configuring a non-contact region 75, situated between the contact areas 70, 72 of the interior surface 62, to have a specific radius of a second value, 75R. Finally, the method may include providing a tie rod nut 50 for installation within each nut pocket 60, the tie rod nut having a third radius value, 56R (56R may equal 58R); and configuring the first, second, and third radii such that the value of the third radius, 56R, is between the values of the first and second radii, 70R and 75R.

Although only one generally described method of forming an improved nut pocket and its associated tie rod nut has been disclosed herein, numerous other variations may fall within the spirit and scope of this disclosure.

What is claimed is:

1. A fluid powered hammer assembly, comprising:

a power cell, a piston configured for reciprocal movement along an axis by the power cell, a hammer tool having a first end juxtaposed against the piston for accommodating cyclic impacts by the piston, the first end being contained within a housing and a second end extending from the housing, the power cell and the housing being axially secured together by a plurality of tie rods and tie rod nuts secured to ends of the tie rods; the housing having exterior nut pockets, and the nuts being contained within the nut pockets;

wherein an exterior body portion of each tie rod nut is circular, defining a fixed radius;

wherein each nut pocket is defined by a circumferentially extending interior wall sized to receive one tie rod nut, the interior wall defining variable radii; and wherein the exterior body portion of each tie rod nut is configured to engage the interior wall of one corresponding nut pocket in at least two spaced apart areas of the nut pocket.

2. The fluid powered hammer assembly of claim 1, wherein the two spaced apart areas of the nut pocket each comprises a tie rod nut contact area.

3. The fluid powered hammer assembly of claim 2, wherein each of the tie rod nut contact areas has a first radius, and each corresponding tie rod nut has a second radius, and wherein the first radius is greater than the second radius.

4. The fluid powered hammer assembly of claim 1, wherein each nut pocket has a major and minor axis, and an orientation such that the major axis is vertically oriented and generally parallel to the orientation of the hammer tool.

5. The fluid powered hammer assembly of claim 1, wherein the housing comprises a front head of a hammer tool.

6. The fluid powered hammer assembly of claim 5, wherein one tie rod nut is situated at each corner of the front head.

7. The fluid powered hammer assembly of claim 1, wherein each of the spaced contact areas of the nut pocket are of metal material, and are work hardened.

8. The fluid powered hammer assembly of claim 1, wherein each of the spaced contact areas of the nut pockets is rectangular in shape.

9. A front head configured for use in a fluid powered hammer assembly, the front head comprising:

a housing adapted for securement to a power cell, and for supporting a piston configured for reciprocal movement by the power cell along an axis of the housing, and a hammer tool including a first end juxtaposed against the piston for accommodating cyclic impacts by the piston, the first end of the hammer tool being contained within the housing and a second end thereof extending from the housing;

wherein the housing is configured to receive a plurality of tie rods and nuts secured to ends of the tie rods for axially holding the power cell and the housing together; the housing further having exterior nut pockets, and the tie rod nuts being contained within the nut pockets;

wherein an exterior body portion of each tie rod nut is circular, defining a fixed radius;

wherein each nut pocket is defined by a circumferentially extending interior wall sized to receive one tie rod nut, the interior wall defining variable radii; and wherein the exterior body portion of each tie rod nut is configured to engage the interior wall of one corresponding nut pocket in at least two spaced apart areas of the nut pocket.

10. The front head of claim 9, wherein the two spaced apart areas of the nut pocket each comprises a tie rod nut contact area.

11. The front head of claim 10, wherein each of the tie rod nut contact areas has a first radius, and each corresponding tie rod nut has a second radius, and wherein the first radius is greater than the second radius.

12. The front head of claim 9, wherein each nut pocket has a major and minor axis, and an orientation such that the major axis is vertically oriented and generally parallel to the orientation of the hammer tool.

13. The front head of claim 9, wherein the housing comprises a front head of a hammer tool.

14. The front head of claim 13, wherein one tie rod nut is situated at each corner of the front head.

15. The front head of claim 9, wherein each of the spaced contact areas of the nut pocket are of metal material, and are work hardened.

16. The front head of claim 9, wherein each of the spaced contact areas of the nut pockets are rectangular in shape.

* * * * *